United States Patent [19]

Bowditch

[11] Patent Number: 4,512,269

[45] Date of Patent: Apr. 23, 1985

[54] AUTOMATED ASSEMBLY SYSTEM FOR SEAMED ARTICLES

[75] Inventor: Philip N. Bowditch, Cohasset, Mass.

[73] Assignee: The Charles Stark Draper Laboratory, Inc., Cambridge, Mass.

[21] Appl. No.: 515,126

[22] Filed: Jul. 19, 1983

[51] Int. Cl.[3] ..... D05B 3/00; D05B 27/00

[52] U.S. Cl. ..... 112/121.12; 112/121.14; 112/121.15; 112/147; 112/304; 112/311; 112/312

[58] Field of Search ..... 112/121.12, 121.11, 112/121.15, 121.14, 147, 304, 308, 309, 310, 311, 312, 275; 270/32, 37, 45, 58; 493/417, 450

[56] References Cited

U.S. PATENT DOCUMENTS

| | | | |
|---|---|---|---|
| 3,450,076 | 6/1969 | Bender | 112/121.15 |
| 3,483,835 | 12/1969 | Krnac et al. | 112/311 |
| 3,589,320 | 6/1971 | Beazley | 112/309 X |
| 3,759,200 | 9/1973 | Marforio | 112/311 |
| 4,274,345 | 6/1981 | Schneider et al. | 112/147 X |
| 4,312,281 | 1/1982 | Doyen et al. | 112/121.11 |
| 4,425,858 | 1/1984 | Hargett | 112/121.15 X |
| 4,435,837 | 3/1984 | Abernathy | 112/275 X |

*Primary Examiner*—H. Hampton Hunter
*Attorney, Agent, or Firm*—Lahive & Cockfield

[57] ABSTRACT

A system for the manufacture of seamed articles from a strip of limp fabric includes an apparatus for feeding strips of fabric and for automatically folding the strips along desired fold lines. A fabric joining apparatus forms seams in the folded strips of fabric at desired locations while providing near-field control of the fabric using selectively operative feed dogs and far-field control using a matrix of selective retractable endless belts.

21 Claims, 10 Drawing Figures

AUTOMATED ASSEMBLY SYSTEM FOR SEAMED ARTICLES

The subject matter of this application is related to that of my U.S. application Ser. No. 231,381, entitled "System and Method for Manufacturing Seamed Articles", filed on Feb. 4, 1981, now U.S. Pat. No. 4,401,044 dated Aug. 20, 1983 and my U.S. patent application Ser. No. 345,756, entitled "Automated Seamed Joining Apparatus", filed Feb. 4, 1983 and now U.S. Pat. No. 4,457,243 dated July 3, 1984. Those applications are incorporated herein by reference.

BACKGROUND OF THE INVENTION

This invention relates to the assembly of seamed articles made from limp fabric. In particular, the invention relates to systems for automated, or computer-controlled, assembly of seamed articles from limp fabric.

Conventional assembly line manufacture of seamed articles constructed of limp fabric consists of a series of manually controlled assembly operations. Generally tactile presentation and control of the fabric-to-be-joined is made to the joining, or sewing, head under manual control. One drawback of this application technique is that the technique is labor intensive; that is, a large portion of the cost for manufacture is spent on labor. To reduce cost, automated or computer-cohtrolled manufacturing techniques have been proposed in the prior art. Such methods are exemplified by the U.S. patent applications incorporated herein by reference.

An automated approach to fabric presentation and control is disclosed in U.S. patent application Ser. No. 345,756. As there disclosed, pairs of belt assemblies are positioned on either side of a planar fabric locus. The respective belt assemblies are driven to selectively provide relative motion along a reference axis to layers of fabric lying in the fabric locus. A sewing head is adapted for motion adjacent to the fabric locus along an axis perpendicular to the reference axis. The respective belts maintain control of the limp fabric in the region traversed by the sewing head, with the respective belts being selectively retracted, permitting passage therebetween of the sewing head as it advances along its axis of motion. With this approach, control of the limp fabric is permitted in the regions which are to be joined. However, this control is maintained on a relatively coarse scale, and, further, the motions available to the fabric under such control are relatively limited.

Accordingly, it is an object of the present invention to provide an improved system for fabric presentation to a joining head.

It is another object to provide a system for joining layers of limp fabric while establishing two axis control of the respective layers of fabric. With such, axis control, easing (that is, joining of different length contours) may be attained, and as well as the formation of three dimensional seaming operations (wherein two same-length contours are joined).

SUMMARY OF THE INVENTION

Briefly, the present invention is a system for the manufacture of seamed articles from a strip of limp fabric. The system includes a feeder for selectively feeding these strips of limp Fabric in the direction of a first (Y) reference axis. Control of presentation may also be maintained in a second (X) axis perpendicular to and intersecting the Y axis.

A folding apparatus controls the position of the fabric so that the strip of fabric is folded onto itself along a fold axis offset from the axis of feed (Y axis) so that there is a folded portion having an upper layer overlying a lower layer. A support is used to position the upper and lower layers of the folded portion in a substantially planar fabric locus.

In one form of the invention, the support includes a frame member, a support assembly coupled to the feeder, and a drive motor and an associated linkage for selectively positioning the frame member with respect to the support assembly in the direction of the X axis. A pair of lower belt assemblies is coupled to the frame member, where each lower belt assembly includes a plurality of continuous loop lower belts underlying the fabric locus. The lower belts have planar uppermost portions adapted on their outer, uppermost surface for frictional coupling with the lower layer of the folded portion. The lower belt assemblies are adjacently positioned along the X axis, with each assembly including an associated driver for selectively driving the lower belts so that the lower fabric layer coupled to those belts is positionable in the direction of the X axis.

A pair of upper belt assemblies is coupled to the frame member as well. The upper belt assemblies are adapted to be positioned to overlie the lower belt assemblies. Each of the upper belt assemblies includes a plurality of upper belts (which may be positioned opposite the respective lower belts). The upper belts have planar lowermost portions spaced apart from the uppermost of the lower belts. The upper belts are adapted on their outer, lowermost surface for frictional coupling with the upper layer of the folded portion. Each of the upper belt assemblies has an associated driver for selectively driving those upper belts so that the lower layer coupled to those belts is positionable in the direction of the X axis. The region between the lowermost portions of the upper belts and the uppermost portions of the lower belts defines the fabric locus, so that the fabric locus is substantially parallel to the plane formed by the intersecting X and Y axes.

In general, a computer-controller is used to selectively control the drivers for the respective belts so that the upper and lower layers may be substantially independently positioned in the direction of the X axis along the fabric locus. In alternative forms of the invention, the respective belt assemblies may be controllable in the Y axis direction as well, so that the upper and lower layers may be substantially independently positioned in the direction of both the X and Y axes along the fabric locus, thereby permitting control motion of the respective layers in those directions.

A fabric joiner, or sewing head, includes an upper assembly and a lower assembly. These upper and lower assemblies are adapted for tandem motion along the direction parallel to the Y axis between the upper belt assemblies and the lower belt assemblies. An associated driver provides control of the position of the upper and lower assemblies of the joiner along its axis of motion. The joiner is selectively operable to form seams in fabric in the fabric locus under the control of a computer-controller.

In one form of the invention, at least one pair of the pairs of the adjacent belt assemblies includes opposing pairs of closed loop belts and an associated controller adapted so that the pairs of the closed loop belts are selectively retractable in the X direction to permit passage of the joining head therebetween in the Y direction.

The joining head may include a needle assembly having a thread-carrying, elongated needle extending along a needle reference axis perpendicular to the fabric locus. In operation, the needle is driven through the fabric locus in a reciprocal motion along the needle reference axis. The needle assembly further includes an upper feed dog assembly which is responsive and applied upper dog drive signal for selectively driving the uppermost layer of fabric in the region adjacent to the needle in the direction of an upper axis which is perpendicular to the needle reference axis.

A bobbin assembly is generally used in this form of the invention and is adapted for interaction with the needle assembly to form the stitches. The bobbin assembly includes a lower feed dog assembly which is responsive to a lower dog drive signal for selectively driving the lowermost layer of fabric in the region adjacent to the needle in the direction of a lower axis which is perpendicular to the needle reference axis. A computer-controller is generally used to selectively rotate the needle assembly and bobbin assembly about the needle reference axis. The controller is operative to control the rotation of the needle and bobbin assemblies in tandem, or independently.

In one form of the invention, the system includes a controller for generating a part assembly signal representative of the desired position of the junction of the layers of fabric relative to those layers. Registration sensors provides signal representative of the current position of the respective uppermost and lowermost fabric layers. A controller provides overall control for the belt assemblies as well as the feed dogs and needle and bobbin assembly rotational and feed dog control, in order to achieve coordinated motions of the respective assemblies. With this configuration, the respective belt assemblies provide far field, or global, position control for the upper and lower fabric layers. The feed dogs provide near field, or local, position control for the upper and lower layers of fabric in the regions near the needle of the joining head.

BRIEF DESCRIPTION OF THE DRAWINGS

The foregoing and other objects of this invention, the various features thereof, as well as the invention itself, may be more fully understood from the following description, when read together with the accompanying drawings in which.

DESCRIPTION OF THE PREFERRED EMBODIMENT

Figure 1:
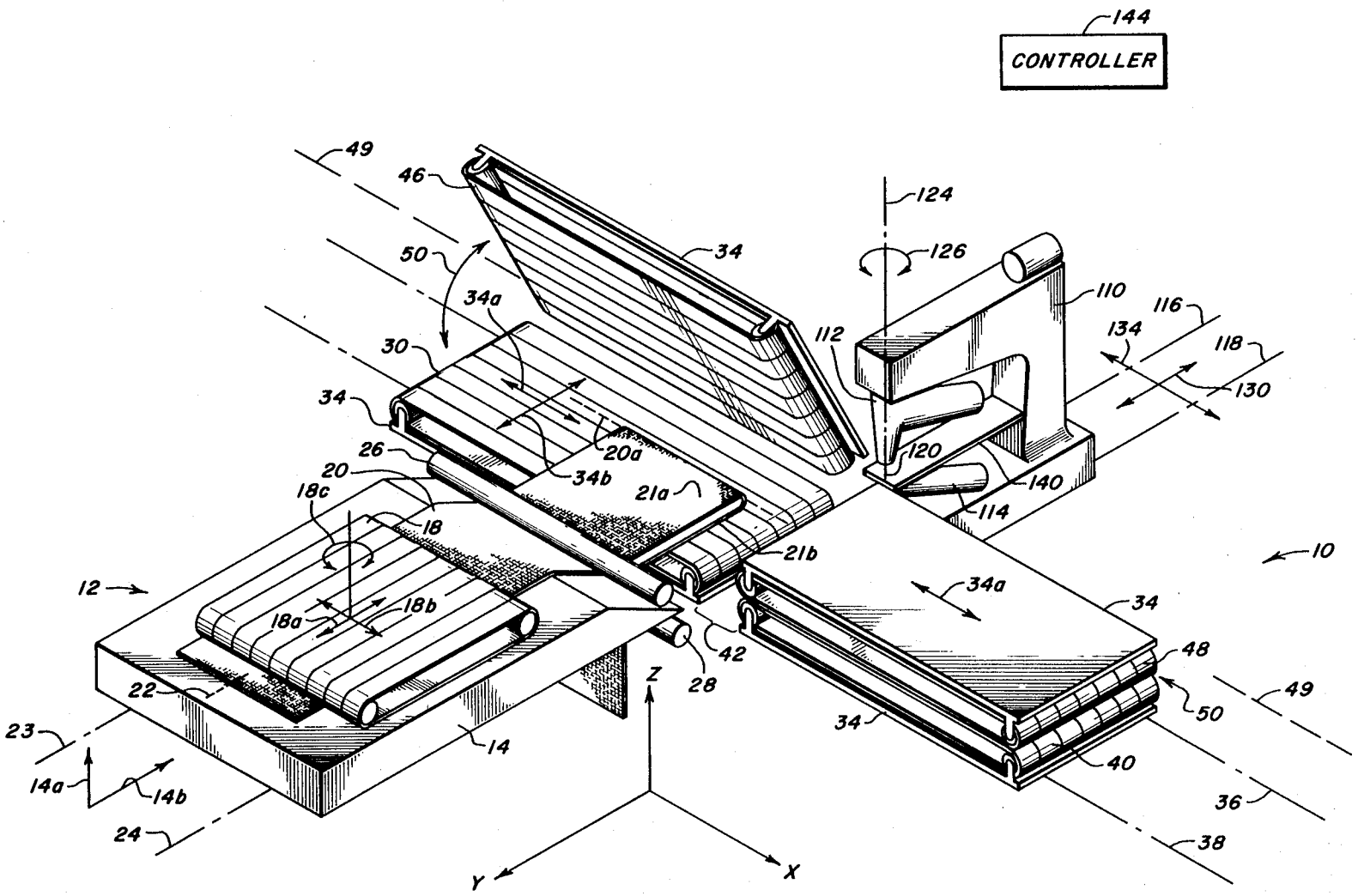
FIG. 1 shows an isometric representation of the principal elements of an exemplary embodiment of the present invention.

FIG. 1 show an isometric representation of the principal elements of a preferred form of an assembly system 10, together with a set of intersecting reference coordinate axes X, Y and Z.

In FIG. 1, a fabric feed assembly 12 is gnereally shown to include a fabric transport plate 14 and a fabric transport belt assembly 18. An elongated strip of limp fabric 20 is hown positioned between the transport belt assembly 18 and the plate 14. The elongated strip of fabric 20 is characterized by a fabric axis 22 extending along its elongated dimension. The plate 14 is coupled to feeder frame (not shown in FIG. 1) which is coupled to the plate 14 a linkage permitting motion of plate 14 along transport ways (not shown in FIG. 1) which are coaxial with the axes 23 and 24 (which in turn are parallel to the Y axis.)

The assembly 12 is generally adapted to feed fabric in the direction of the Y axis. As described in more detail below, the plate 14 is moveable in the directions of arrows **14*a* and 14*b*, and the belt assembly 18 is moveable in the direction of arrows 18*a*, 18*b* and 18*c***.

The system 10 further includes a fabric folding assembly composed generally of the plate 14, a fold conformation roller 26, a fold take-up roller 28 and a belt assembly 30. The supporting mechanisms and associated drive motors and linkages for these elements are not shown in FIG. 1. The fabric folding assembly is adapted to fold portions of fabric 20 onto itself along a fold axis **20*a* (offset from axis 22) to form an upper portion 21*a* and a lower portion 21*b***.

A folded fabric support includes a frame member 34 and a support assembly 36. The support assembly 36, includes a linkage and drive motor coupling it to the frame member 34 in a manner permitting motion of the frame member 34 in the direction of the X axis (indicated by arrows **34*a*) along transport ways (not shown in FIG. 1) which are coaxial with the axes 36 and 38 (which in turn are parallel to the X axis). In the present embodiment, a linkage and drive motor further provides controlled motion of frame 34 in the direction of arrow 34*b***.

The folded fabric support includes a pair of lower belt assemblies 30 and 40 coupled to frame member 34. Belt assemblies 30 and 40 include a plurality of continuous loop belts. The outermost surfaces of the belts are adapted for frictional coupling to portions of the fabric 20 which are positioned adjacent thereto.

The belt assemblies 30 and 40 are adjacently positioned along the X axis, with a gap 42 between them. The folded fabric support further includes motors and associated linkages (not shown in FIG. 1) for selectively driving the continuous loop belts of assemblies 30 and 40.

A pair of upper belt assemblies 46 and 48 are also coupled to the frame member 34. Each of the belt assemblies 46 and 48 include a plurality of continuous loop belts. The upper belts are adapted on their outer surface for frictional coupling to portions of fabric 20 adjacent thereto.

In the present embodiment, the belt assemblies 46 and 48 are coupled to the frame member 34 in a manner permitting pivotal motional of those belt assemblies 46 and 48 about an axis 49 parallel to the X axis. In FIG. 1, the belt assembly 46 is shown in an upper position, while that belt assembly 46 may also be angularly displaced as indicated by arrow 50 to be in a position so that the belts of assembly 46 are opposite and spaced apart (in the B direction) from the belts of assembly 30. The assembly 48 is similarly configured. As shown, the belt assembly 48 is positioned above belt assembly 40 so that the belts of assembly 48 are opposite and spaced apart (in the Z direction) from the belts of assembly 40. With this configuration, the belts of assemblies 46 and 48 are positioned on one side of a substantially planar fabric locus 50 in the plane of the X and Y axes, while the belts of the assemblies 30 and 40 are positioned below that fabric locus 50.

The system 10 further includes a fabric joiner 110 in the form of a sewing machine with an upper (needle) assembly 112 and a lower (bobbin) assembly 114. A fabric plate 140 extends from the joiner 110 in a plane substantially parallel to the upper surface of the belts of assemblies 30 and 40. The joiner 110 is selectively moveable along transport ways (not shown in FIG. 1) which are coaxial with axis 116 and 118. The transport ways for the joiner 110 are fixably coupled to the frame member 34.

In the present embodiment, the needle assembly 112 includes an enlongated needle 120 extending along an axis 124 and an upper feed dog assembly 126 (not shown in FIG. 1). The joiner 110 is adapted for selectively controlled reciprocal motion of the needle 120. The assembly 112 further may be selectively rotated, about the axis 124 as indicated by the arrow 126.

The bobbin assembly 114 includes a lower feed dog assembly 128. The bobbin assembly 114 is positioned below the fabric plate 140, and is adapted for selectively controlled rotation about axis 124. As described more fully below, the rotation of the assemblies 112 and 114 maybe independant or in tandem. The joiner 110 further includes a motor and associated drive linkage for controlling the position of joiner 110 in the direction of arrow 130 (which is parallel to the Y axis) is not shown in FIG. 1.

With this configuration, since the joiner 110 is fixably coupled to the frame 34, that joiner 110 moves with frame 34 in the direction of arrow 134.

FIG. 1 further shows a controller 144 for controlling the various motors for driving the respective elements of system 10. Although not shown in FIG. 1, upper and lower fabric registration position sensors 191 and 193, respectively, shown in FIG. 2, coupled to frame 34 may be used to generate signals representative of the position of the portions of fabric 22 within the fabric locus 50. As described below, these signals may be used in conjunction with controller 144 and the remainder of system 110 to provide fully automated assembly operation.

Figure 2:
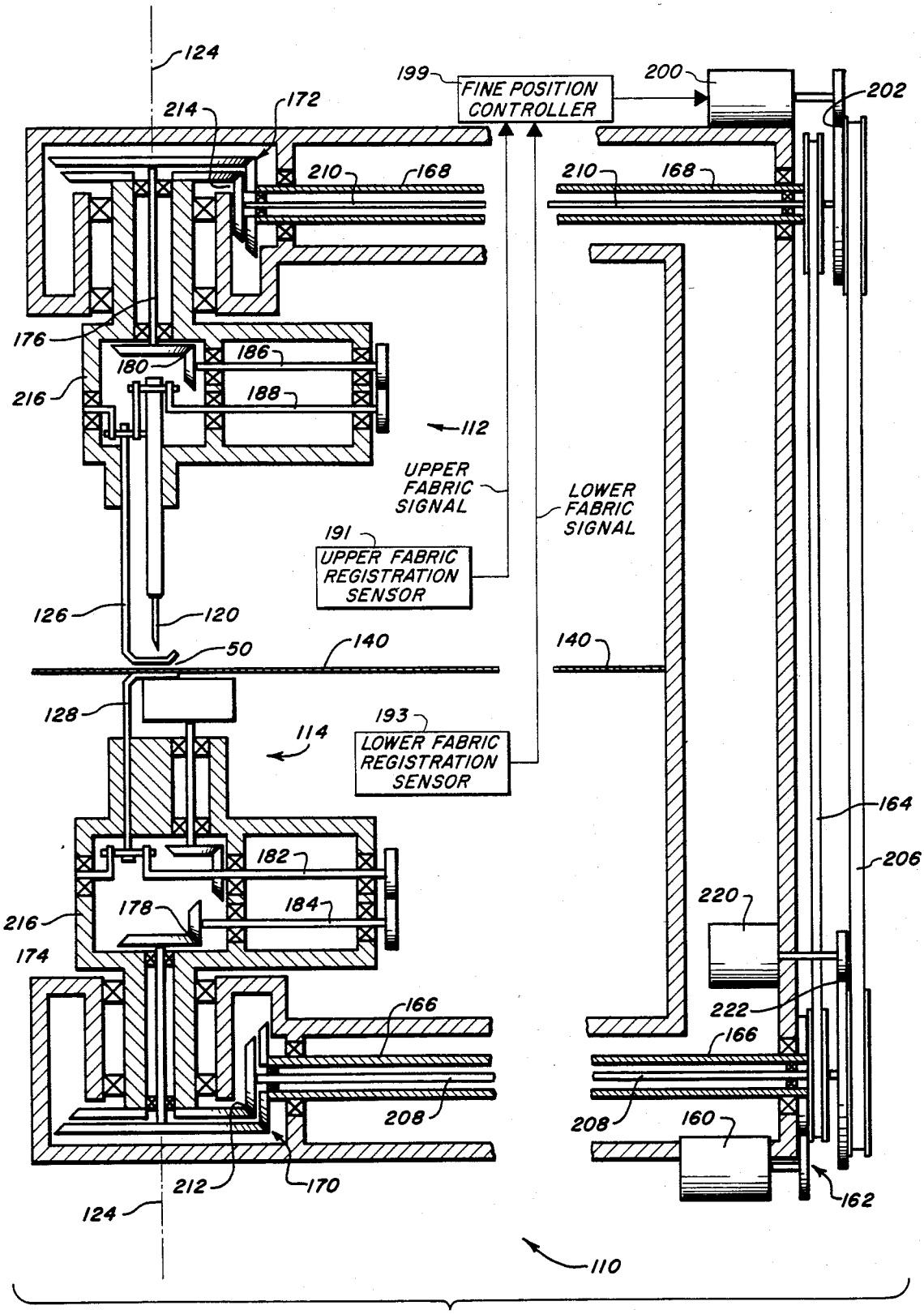
FIG. 2 shows a cross-section of one form of fabric joiner for the system of FIG. 1.

FIG. 2 shows a sectional view of the joiner 110. The joiner 110 includes a motor 160 which is coupled by way of gear assembly 162, belt 164, hollow shafts 166 and 168, bevel gear assemblies 170 and 172, shafts 174 and 176, pedal gear assemblies 178 and 180, shafts 182, 184, 186 and 188. This assembly provides the conventional-type motions of the needle 120, bobbin assembly 114 and associated feed dogs 126 and 128.

In the present embodiment, a motor 200 is coupled by way of gear assembly 202, belt 206, shafts 208 and 210, pedal gear assemblies 212 and 214, and journaled housing members 216 and 220. This assembly provides rotational motion of the needle assembly 112 and bobbin assembly 114 about the axis 124.

In the present embodiment, in addition, a motor 220 is coupled by way of gear assembly 222 to the shaft 208 together with a clutch assembly (not shown) to permit differential rotation of needle assembly 112 and bobbin assembly 114. With this differential rotation capacity, the system 10 may provide nulling of stitch line registration to the edges of the work pieces, as required.

The operation of motor 200 controls the angular orientation of needle assembly 112 and bobbin assembly 114 about the needle axis 124 as required to provide that the stitching line bears the correct azimuth to the main frames of the system 10, as directed by steering logic and the x,y motion of the sewing head relative to the folded portions 21*a* and 21*b*.

All the operation of the motors 160, 200 and 220 is controlled by controller 144 in the present embodiment. In alternative embodiments, separate processors, which might be linked, may be used to control the various motors and operations of the system 10. For example, FIG. 2 shows fine position controller 199 which controls motor 200 in response to upper and lower fabric signals generated by sensors 191 and 193.

In alternative embodiments, separate motors may directly control the rotary motions of the respective needle and bobbin assemblies 112 and 114.

Figure 3A:
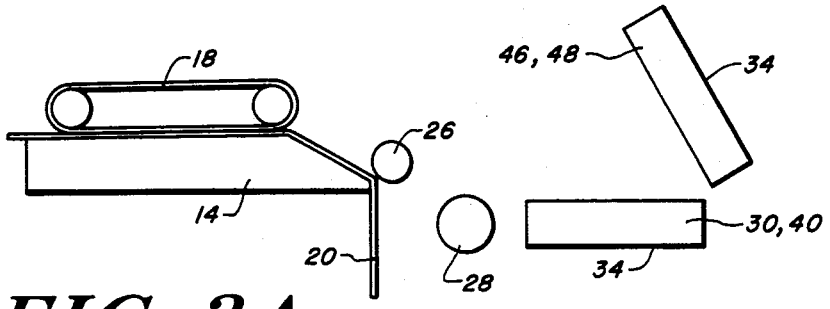
FIGS. 3A–3F illustrate the operation of the fabric folding assembly of the system of FIG. 1.

FIGS. 3A–3F illustrate the operation of the fabric folding assembly. These FIGS. 3A–3F show the principal portions of the fabric folding assembly on a side elevation view. In a first step, as shown in FIG. 3A, the fabric 20 is fed by roller assembly 18 to extend beyond the plate 14 and downward below the fold confirmation roller 26. In this phase of the folding operation, the frame 34 which is coupled to the upper belt assemblies 46 and 48 are shown in their uppermost position, while the frame assembly 34 which supports assemblies 30 and 40 is positioned on the transports which track along axis 36 and axis 38. The fold takeup roller 28 is not operative in this portion of the operation.

Figure 3B:
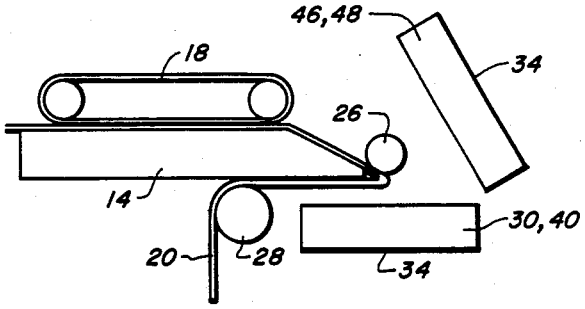

FIG. 3B shows the next stage of operation, where the fold plate 14 has been driven in the direction 14*b* together with the roller 26 so that the fabric 20 on plate 14 extends within the fabric locus (i.e., between the assemblies 30, 40 and 46, 48). The fabric 20 at this point, is long enough to extend over the roller 28.

Figure 3C:
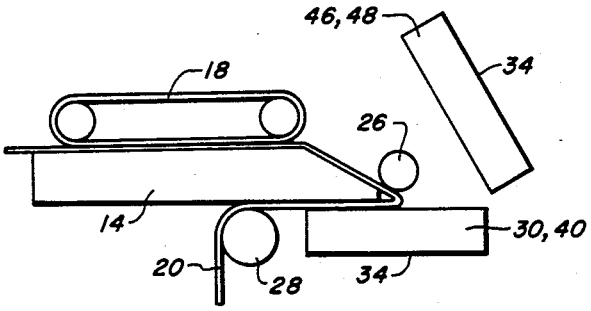

As the next step, as shown in FIG. 3C, the roller 26 is directed in a downward motion to pinch the end of the fabric 20 between that roller 26 and the upper surfaces of the belts 30, 40.

Figure 3D:
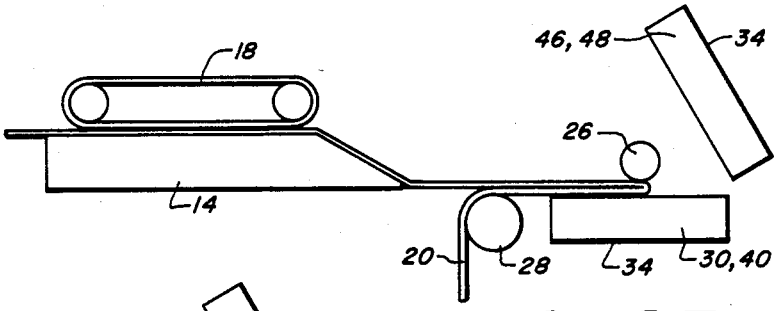
Figure 3E:
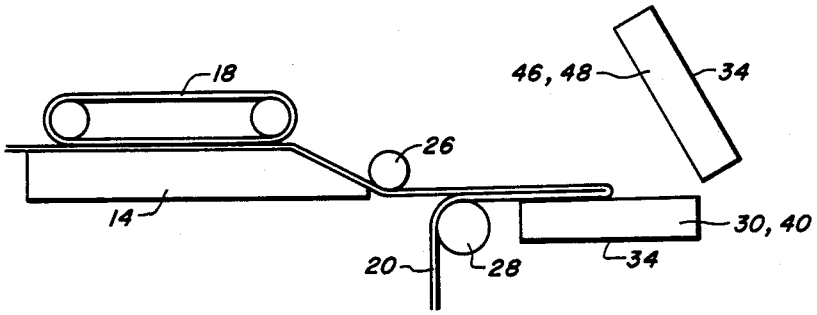
Figure 3F:
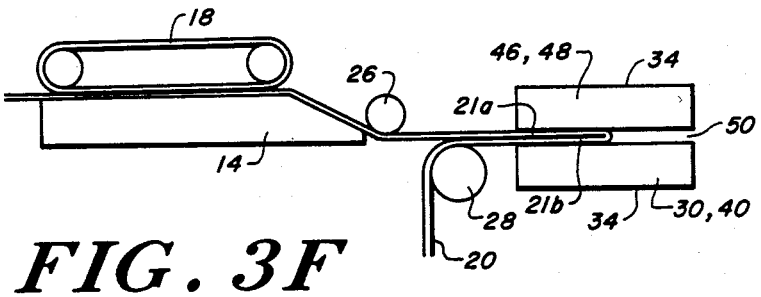

Then, as shown in FIG. 3D, the plate 14 retracts, while the roller 26 remains in its lowermost position, maintaining the folded fabric within the fabric locus 50. Thereafter, as shown in FIG. 3E, the roller 26 retracts to its original position, so that only the folded fabric remains within the fabric locus. Then, as shown in FIG. 3F, the frame 34 which supports the belts 46 and 48 is pivotally positioned so that the lower portions of belts 46 and 48 descend to be adjacent to the upper layer of the folded portion of the fabric within the fabric locus. At this point, the opposing surfaces of belts 30, 40 and belts 46, 48 are in frictional contact with the respective lower and upper portions of the folded fabric which are within fabric locus 50. Thereafter, the respective motions of the belts of the assemblies 30, 40 and 46, 48 may independently control the upper and lower portions of the folded fabric. Moreover, the entire frame 34 may be moved in the X direction by controlling the motion of the respective belts to provide "military tank" motions so that the respective belt assemblies can traverse the fabric without distorting the current position of the folded fabric portions 21*a* and 21*b*.

Figure 4:
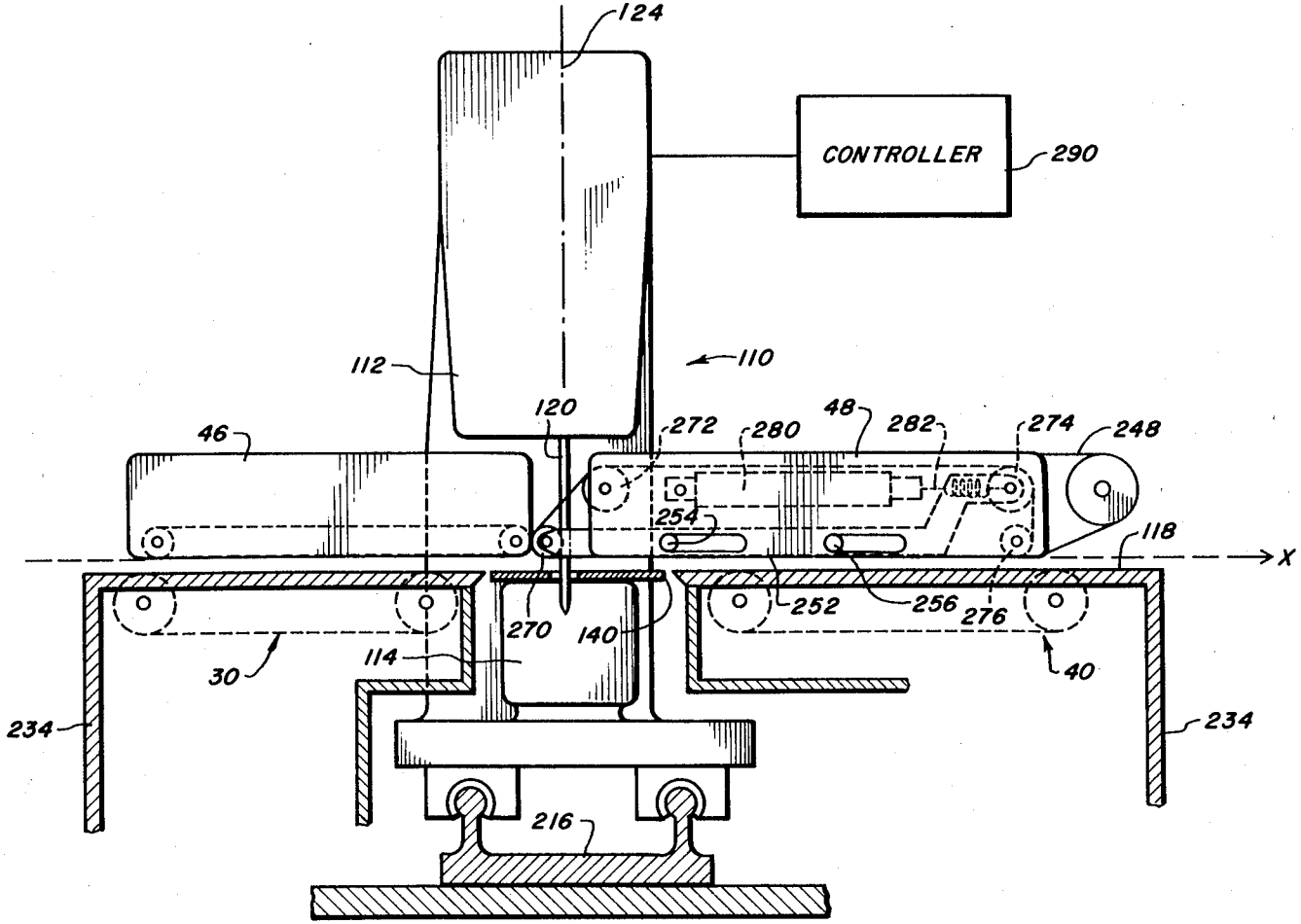
FIG. 4 illustrates a fabric support assembly adapted for use with the system of FIG. 1.

By way of example, FIG. 4 shows an exemplary configuration for the belt assemblies 30, 40 and 46, 48 where various opposed belts in the group of belts 46, 48 are selectively retractable to permit passage there between of the needle 120 of the joiner 110. The operation of this configuration is described in detail in the incorporated reference U.S. patent application Ser. No. 345,756. Briefly, in FIG. 4, joiner 110 is adapted for motion along transport ways 216 (along axes 116 and 118). The frame 234 in FIG. 4 corresponds to the frame 34 in FIG. 1 and is adapted for motion along the direction of the X axis. The end most belt 248 of the upper belt assembly, as shown in FIG. 4, is adapted to pass around four rollers 270, 272, 274 and 276. The rollers 272 and 276 are fixed with respect to the frame 34. The rollers 270 and 274 are adapted to permit translational in the X direction motion with respect to that frame 34. The rollers 270 and 274 are coupled by way of link 252 which is guided by pins 254 and 256 to permit the motion of the rollers 270 and 274 in the direction of the X axis. A pneumatic actuator 280 and associated spring 282 is coupled between the frame 34 and the roller 274, and in its normally retracted position, actuator 280, when energized, is positioned as shown in FIG. 4 together with rollers 270 and 274 as shown in that figure (in its energized position).

When the solenoid 280 is de-energized, the rollers 274 and 270 are displaced so that the link 252 is positioned against pins 254 and 256 at its other extreme point, with the result that the portion of belt 248 which was previously in the gap between the assemblies 46 and 48 is retracted therefrom, permitting the needle 120 to pass between the respective belt assemblies at that point. With this operation, the coordinated switching of the belt 248 together with the other belts in the assembly (as controlled by a spool value with a shuttle) may be accomplished as the needle 120 is moved in the direction of the Y axis (as the joiner 110 is advanced or retracted in the direction 130). The controller 290 for controlling this coordinated activity of the respective belts may be combined in the controller 144 in various embodiments of the invention, or may be a separate controller acting in concert with the controller 144.

With the configuration described above in conjunction FIGS. 1–4, an enlongated strip of fabric 20 may be fed to the support assembly, where that fabric may be folded across a fold axis which is offset with respect to the fabric's principle axis. When in the folded position, the respective upper and lower belt assemblies may be used to adjustively position the respective upper and lower layers **21*a* and 21*b* of the folded fabric. The belt assemblies may provide global control of the fabric for presentation to the sewing head. The feed dog assemblies which may be selectively rotated together with the needle assembly 112 and bobbin assembly 114, provide local control of the limp fabric for presentation to the needle 120 in the region immediately adjacent to that needle. Thus, the limp fabric is automatically folded and presented for assembly operations. By controlling the belts to adjustably position the fabric in a coarse manner, and the feed dogs to adjustably position the fabric in a fine manner, the relative positions of the upper and lower layers of the folded portion is controlled in both the X and Y directions. As a result, three dimensional seaming can be accomplished. Furthermore, easing may be accomplished, as well, wherein two different length contours may be joined. In conjunction with operation of the fabric registration sensor, the entire process may be automated, together with the part assembly description which is programmed into the controller 144**. As a consequence, the entire sewing operation may be performed automatically, without human intervention.

In the various modes of operation, the near field control of the fabric in the region of the needle 120 may be performed with differential movements and rotations of the feed dog assemblies 126 and 128. By way of example, variability of feed dog travel for the top and bottom upper and lower feed dogs controls the number of stitches per inch. Differential stroke of the respective feed dog assemblies 126 and 128 provide easing of a seam, when desired. By establishing control of the differential motion of the upper belt assemblies relative to the lower belt assemblies in the Y direction, the generation of non-mirror image seams in the work piece, i.e., three dimensional curves, may be provided. The net result of the Y axis control differential motion of the upper to lower belt assemblies is to roll under or over the stitch line as required to continue flat plane joining and to confirm the allignment required in the Y direction as the seam progresses in the X direction. A further benefit of the Y axis differential belt assembly motion is that fine allignment of the workpiece layers with respect to each other may be accomplished.

Figure 5:
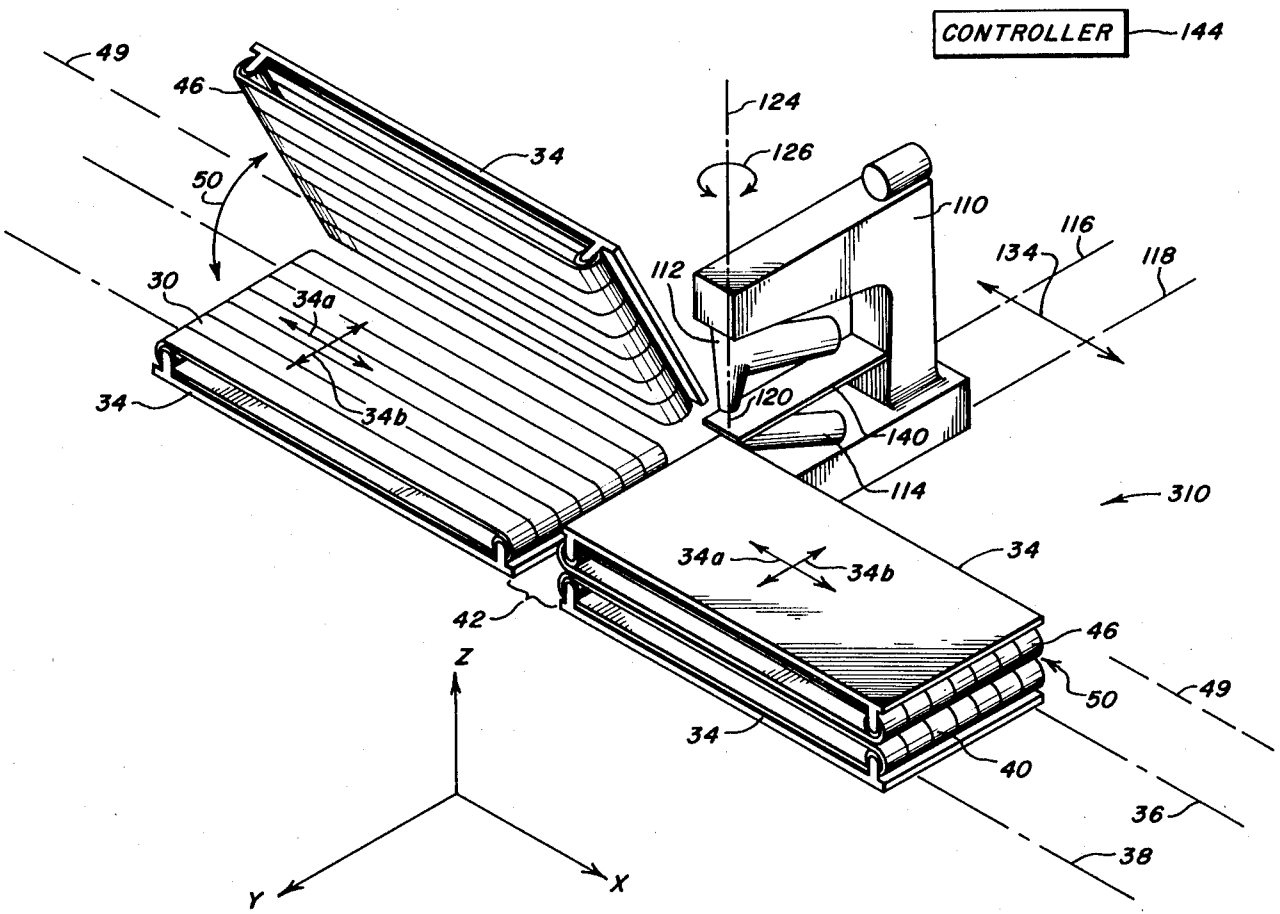
FIG. 5 shows an isometric representation of the principal elements of another exemplary embodiment of the present invention.

FIG. 5 shows an alternative embodiment (denoted system 310) of the present invention which is similar to that shown in FIG. 1. In FIG. 5, elements similar to those shown in FIG. 1 have identical reference designations. The system 310 is an in-line system which includes a feeder (not shown) for feeding a multiple layer fabric workpiece (e.g., including a folded fabric section, or two pre-cut overlapping fabric arrow 50). In the illustrated embodiment of FIG. 5, the belts of the respective belt assemblies 30, 40 and 46, 48 are moveable only in direction **34*a* although in other embodiments, one or more of the belt assemblies may be moveable in the direction 34*b* as well. In system 310, the frame and the joiner 110** are fixedly positioned.

With this configuration, the fabric workpiece may be controllably positioned in the X direction, with the position of the upper and lower layers being independently positionable (permitting easing, where, for example, the upper and lower layers are presented to the needle 120 at differing rates).

The needle assembly 112 and bobbin assembly 114 are rotatable about the axis 124, as shown in FIG. 5; by controllably rotating those assemblies with respect to the remainder of joiner 110. However, in alternate embodiments, the entire joiner 110 may be controllably rotated about axis 110.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all change which come within the meaning and range of equivalency of the claims are therefore intended to be embraced therein.

I claim:

1. System for joining portions of an elongated strip of limp fabric, said strip being characterized by an associated fabric axis extending along its elongated dimension, comprising:

A. feeder means for selectively feeding a strip of limp fabric with its fabric axis parallel to a first (Y) reference axis, said Y axis being perpendicular to a second (X) reference axis and intersecting therewith, B. means for folding a portion of said strip of limp fabric onto itself along a fold axis offset from said fabric axis, said folded portion having an upper layer overlying a lower layer, C. means for supporting said upper and lower layers of said folded portion in a substantially planar fabric locus substantially parallel to said X and Y axes, wherein said supporting means includes:

i. a frame member, a support assembly coupled to said feeder means, and an associated frame X-drive means for selectively positioning said frame member with respect to said support assembly in the direction of said X axis, ii. a pair of lower belt assemblies coupled to said frame member and including a plurality of continuous loop lower belts having a planar uppermost portion underlying said fabric locus and being adapted on their outer surface for frictional coupling with said lower layer of said folded portion, each of said lower belt assemblies being adjacently positioned along said X axis, each of said lower belt assemblies including an associated lower belt drive means for selectively driving said lower belts whereby said lower layer coupled thereto is positionable in the direction of said X axis, iii. a pair of upper belt assemblies coupled to said frame member and including a plurality of continuous loop upper belts having a planar lowermost portion opposite and spaced apart from said planar uppermost portion of said lower belts, said upper belts overlying said fabric locus and being adapted on their outer surface for frictional coupling with said upper layer of said folded portion, each of said upper belt assemblies including an associated upper belt drive means for selectively driving said upper belts whereby said lower layer coupled thereto is positionable in the direction of said X axis, wherein the region between said lowermost portion of said upper belts and said upper portion of said lower belts defines said fabric locus, D. folded fabric controller including means for selectively controlling said lower belt drive means, said upper belt drive means and said frame X-drive means, whereby said upper and lower layers may be substantially independently positioned in said fabric locus in the direction of said X axis, E. fabric joiner including:

i. an upper assembly selectively positionable between said upper belt assemblies along said Y axis and, a lower assembly selectively positionable and between said lower belt assemblies along said Y axis, and said upper assembly being above said fabric locus and said lower assembly underlying said upper assembly and being below said fabric locus, said upper and lower assemblies including selectively operable joining means for joining adjacent regions said upper and lower layers in said fabric locus between said upper and lower assemblies, and ii. joiner drive means for selectively positioning said upper and lower assemblies with respect to said support assembly in the direction of said Y axis, F. fabric joiner controller including means for selectively controlling said joiner drive means to establish a current position of said upper and lower assemblies and for selectively controlling the operation of said joining means at said current position of said fabric joiner.

2. A system according to claim 1 wherein said feeder means includes means for controlling the position of said feeder means, with respect to said support assembly in the direction of said X-axis.

3. A system according to claim 1 wherein at least one of said belt assemblies includes an associated Y-drive means for selectively driving its associated belt assembly with respect to said support assembly in the direction of said Y axis, and wherein said folded fabric controller includes means for selectively controlling said Y-drive means, and whereby said upper and lower layers may be substantially independently positioned in said fabric locus in the direction of said Y axis.

4. A system according to claims 1 or 2 or 3 wherein said joining means includes:

A. a needle assembly including a thread-carrying, elongated needle extending along a needle reference axis perpendicular to said fabric locus, and including associated means for selectively driving said needle with reciprocal motion along said needle reference axis and through said fabric locus, and including an upper feed dog assembly including means responsive to an upper dog drive signal for selectively driving the uppermost layer of fabric in the direction of an upper axis, said upper axis being perpendicular to said needle reference axis, B. a bobbin assembly including a bobbin adapted for interaction with said needle assembly, and a lower feed dog assembly coupled thereto, said lower feed dog assembly including means responsive to a lower dog drive signal for selectively driving the lowermost layer of fabric in the direction of a lower axis, said lower axis being perpendicular to said needle reference axis, and C. means for selectively rotating said needle assembly and said bobbin assembly about said needle reference axis.

5. A system according to claims 1 or 2 or 3 wherein at least one pair of said pairs of adjacent belt assemblies includes pairs of opposed belts and an associated controller, whereby said pairs of opposed belts are selectively retractable in said X direction to permit passage of said joining means therebetween in said Y direction.

6. System for joining portions of an elongated strip of limp fabric, said strip being characterized by an associated fabric axis extending along in its elongated dimension, comprising:

A. feeder means for selectively feeding said strip of limp fabric with its fabric axis parallel to a first (Y) reference axis, said Y axis being perpendicular to a second (X) reference axis and intersecting therewith, B. means for folding a portion of said strip of limp fabric onto itself along a fold axis offset from said fabric axis, said folded portion having an upper layer overlying a lower layer, C. means for supporting said upper and lower layers of said folded portion in a plane fabric locus substantially parallel to said X and Y axes, D. means for independently, selectively positioning said upper and lower layers in the direction of said X axis, E. fabric joiner including a joining means adjacent to said fabric locus and associated means for selectively positioning said joining means with respect to said fabric locus along said Y axis, said joining means including selectively operable means for joining said upper and lower layers in said fabric locus at a current position of said joining means, F. fabric joiner controller including means for establishing a current position of said joining means and for selectively controlling the operation of said joining means.

7. A system according to claim 6 wherein said feeder means includes means for controlling the position of said feeder means, and said fabric thereon, with respect to said support assembly in the direction of said X-axis.

8. A system according to claim 6 further comprising means for independently, selectively positioning said upper and lower layers in the direction of said Y-axis.

9. A system according to claims 6 or 7 or 8 wherein said joining means includes:

A. a needle assembly including a thread-carrying, elongated needle extending along a needle reference axis perpendicular to said fabric locus and associated means for selectively driving said needle with reciprocal motion along said needle reference axis, and through said fabric locus, and an upper feed dog assembly coupled thereto, said upper feed dog assembly including means responsive to an upper dog drive signal for selectively driving the uppermost layer of fabric in the direction of an upper axis, said upper axis being perpendicular to said needle reference axis, B. a bobbin assembly including a bobbin adapted for interaction with said needle assembly, and a lower feed dog assembly including means responsive to a lower dog drive signal for selectively driving the lowermost layer of fabric in the direction of a lower axis, said lower axis being perpendicular to said needle reference axis, and C. means for selectively rotating said needle assembly and said bobbin assembly about said needle reference axis.

10. A system for joining two overlapping layers of limp fabric lying in a substantially planar fabric locus, comprising:

A. a needle assembly including a thread-carrying, elongated needle extending along a needle reference axis perpendicular to said fabric locus, and asssociated means of selectively driving said needle with reciprocal motion along said needle reference axis and through said fabric locus, and an upper feed dog assembly coupled thereto, said upper feed dog assembly including means responsive to an upper dog drive signal for selectively driving the uppermost layer of fabric in the direction of an upper axis, said upper axis being perpendicular to said needle reference axis, B. a bobbin assembly including a bobbin adapted for interaction with said needle assembly, and a lower feed dog assembly coupled thereto, said lower feed dog assembly including means responsive to a lower dog drive signal for selectively driving the lowermost layer of fabric in the direction of a lower axis, said lower axis being perpendicular to said needle reference, and C. means for selectively rotating said needle assembly and said bobbin assembly about said needle reference axis.

11. A system according to claim 10, further comprising:

D. means for generating a part assembly signal representative of the desired position of the junction of said layers of fabric relative to said layers, E. an upper fabric registration sensor including means for detecting the position of the upper most layer of fabric and means for generating an upper fabric signal representative thereof, F. a lower fabric registration sensor including means for detecting the position of the lowermost layer of fabric and means for generating a lower fabric signal representative thereof, G. a gross position controller including means responsive to said upper and lower fabric signals and said part assembly signal for controlling the positions of said layers of fabric to be less than a predetermined distance from said desired position, H. a fine position controller including means responsive to said upper and lower fabric signals and said part assembly signal for generating said upper and lower drive signal and means for controlling the angular position of said needle assembly and said bobbin assembly, whereby said upper and lower feed dog assemblies control the positions of said uppermost and lowermost layers of fabric in regions near said needle to substantially said desired position.

12. A system according to claims 10 or 11 including means for differentially controlling said upper and lower feed dogs.

13. System for joining portions of a multilayer limp fabric workpiece, comprising:

A. feeder means for selectively feeding a multilayer limp fabric workpiece, in the direction of an (X) reference axis, said X axis being perpendicular to a Y reference axis and intersecting therewith, said fabric workpiece having an upper layer overlying a lower layer, B. means for supporting said upper and lower layers of said workpiece in a substantially planar fabric locus substantially parallel to said X and Y axes, wherein said supporting means includes:

i. a frame member coupled to said feeder means, ii. a pair of lower belt assemblies coupled to said frame member and including a plurality of continuous loop lower belts having a planar uppermost portion underlying said fabric locus and being adapted on their outer surface for frictional coupling with said lower layer of said workpiece, each of said lower belt assemblies being adjacently positioned along said X axis, each of said lower belt assemblies including an associated lower belt drive means for selectively driving said lower belts whereby said lower layer coupled thereto is positionable in the direction of said X axis, iii. a pair of upper belt assemblies coupled to said frame member and including a plurality of continuous loop upper belts having a planar lowermost portion opposite and spaced apart from said planar uppermost portion of said lower belts, said upper belts overlying said fabric locus and being adapted on their outer surface for frictional coupling with said upper layer of said workpiece, each of said upper belt assemblies including an associated upper belt drive means for selectively driving said upper belts whereby said lower layer coupled thereto is positionable in the direction of said X axis, wherein the region between said lowermost portion of said upper belts and said upper portion of said lower belts defines said fabric locus, C. fabric controller including means for selectively controlling said lower belt drive means, said upper belt drive means and said frame X-drive means, whereby said upper and lower layers may be substantially independently positioned in said fabric locus in the direction of said X axis, D. fabric joiner including:

i. an upper assembly selectively positionable between said upper belt assemblies along said Y axis and, a lower assembly selectively positionable and between said lower belt assemblies along said Y axis, and said upper assembly being above said fabric locus and said lower assembly underlying said upper assembly and being below said fabric locus, said upper and lower assemblies including selectively operable joining means for joining adjacent regions said upper and lower layers in said fabric locus between said upper and lower assemblies, and ii. joiner drive means for selectively positioning said upper and lower assemblies with respect to said frame member assembly in the direction of said Y axis, E. fabric joiner controller including means for selectively controlling said joiner drive means to establish a current position of said upper and lower assemblies and for selectively controlling the operation of said joining means at said current position of said fabric joiner.

14. A system according to claim 13 wherein said feeder means includes means for controlling the position of said feeder means, with respect to said support assembly in the direction of said X-axis.

15. A system according to claim 13 wherein at least one of said belt assemblies includes an associated Y-drive means for selectively driving its associated belt assembly with respect to said support assembly in the direction of said Y axis, and wherein said folded fabric controller includes means for selectively controlling said Y-drive means, and whereby said upper and lower layers may be substantially independently positioned in said fabric locus in the direction of said Y axis.

16. A system according to claims 13 or 14 or 15 wherein said joining means includes:

A. a needle assembly including a thread-carrying, elongated needle extending along a needle reference axis perpendicular to said fabric locus, and including associated means for selectively driving said needle with reciprocal motion along said needle reference axis and through said fabric locus, and including an upper feed dog assembly including means responsive to an upper dog drive signal for selectively driving the uppermost layer of fabric in the direction of an upper axis, said upper axis being perpendicular to said needle reference axis, B. a bobbin assembly including a bobbin adapted for interaction with said needle assembly, and a lower feed dog assembly coupled thereto, said lower feed dog assembly including means responsive to a lower dog drive signal for selectively driving the lowermost layer of fabric in the direction of a lower axis, said lower axis being perpendicular to said needle reference axis, and C. means for selectively rotating said needle assembly and said bobbin assembly about said needle reference axis.

17. A system according to claims 13 or 14 or 15 wherein at least one pair of said pairs of adjacent belt assemblies includes pairs of opposed belts and an associated controller, whereby said pairs of opposed belts are selectively retractable in said X direction to permit passage of said joining means therebetween in said Y direction.

18. System for joining portions of a multilayer limp fabric workpiece, comprising:

A. feeder means for selectively feeding said multilayer limp fabric workpiece in the direction of an X reference axis, said X axis being perpendicular to a Y reference axis and intersecting therewith, said fabric workpiece having an upper layer overlying a lower layer, B. means for supporting said upper and lower layers of said workpiece in a plane fabric locus substantially parallel to said X and Y axes, C. means for independently, selectively positioning said upper and lower layers in the direction of said X axis, D. fabric joiner including a joining means adjacent to said fabric locus and associated means for selectively positioning said joining means with respect to said fabric locus along said Y axis, said joining means including selectively operable means for joining said upper and lower layers in said fabric locus at a current position of said joining means, E. fabric joiner controller including means for establishing a current position of said joining means and for selectively controlling the operation of said joining means.

19. A system according to claim 18 wherein said feeder means includes means for controlling the position of said feeder means, and said fabric thereon, with respect to said support assembly in the direction of said X-axis.

20. A system according to claim 18 further comprising means for independently, selectively positioning said upper and lower layers in the direction of said Y-axis.

21. A system according to claims 18 or 19 or 20 wherein said joining means includes:

A. a needle assembly including a thread-carrying, elongated needle extending along a needle reference axis perpendicular to said fabric locus and associated means for selectively driving said needle with reciprocal motion along said needle reference axis, and through said fabric locus, and an upper feed dog assembly coupled thereto, said upper feed dog assembly including means responsive to an upper dog drive signal for selectively driving the uppermost layer of fabric in the direction of an upper axis, said upper axis being perpendicular to said needle reference axis, B. a bobbin assembly including a bobbin adapted for interaction with said needle assembly, and a lower feed dog assembly including means responsive to a lower dog drive signal for selectively driving the lowermost layer of fabric in the direction of a lower axis, said lower axis being perpendicular to said needle reference axis, and C. means for selectively rotating said needle assembly and said bobbin assembly about said needle reference axis.

* * * * *